United States Patent [19]

Goksel

[11] 4,412,840

[45] Nov. 1, 1983

[54] PELLETIZING LIGNITE

[75] Inventor: Mehmet A. Goksel, Houghton, Mich.

[73] Assignee: The United States of America as represented by the U.S. Department of Energy, Washington, D.C.

[21] Appl. No.: 225,491

[22] Filed: Jan. 16, 1981

Related U.S. Application Data

[63] Continuation of Ser. No. 82,666, Oct. 9, 1979, abandoned.

[51] Int. Cl.[3] ..... C10L 5/16; C10L 5/26

[52] U.S. Cl. ..... 44/10 D; 44/1 G; 44/23

[58] Field of Search ..... 44/1 G, 10 D, 23

[56] References Cited

U.S. PATENT DOCUMENTS

| | | | |
|---|---|---|---|
| 1,290,992 | 1/1919 | Hite | 44/23 |
| 1,382,629 | 6/1921 | Darling | 44/23 |
| 1,477,642 | 12/1923 | Gallsworthy | 44/1 G |
| 1,556,036 | 10/1925 | Schoch | 44/1 G |
| 2,008,147 | 7/1935 | Morrell | 44/23 |
| 2,310,095 | 2/1943 | Lance et al. | 44/23 X |
| 2,618,537 | 11/1952 | Rabu | 44/23 |
| 4,302,209 | 11/1981 | Baker et al. | 44/10 D |

OTHER PUBLICATIONS

Thermal Pretreatment and Pelletizing of No. Dakota Lignite, Oppelt et al., Report of Investigation 5382, U.S. Dept. of the Interior, 1958.

A Briquetting Process Using Pitch Emulsion, Proceedings 5th Biennial Briquetting Conference, pp. 33–37.

*Primary Examiner*—Carl F. Dees

*Attorney, Agent, or Firm*—Hugh W. Glenn; Robert J. Fisher; Richard C. Besha

[57] ABSTRACT

Lignite is formed into high strength pellets having a calorific value of at least 9,500 Btu/lb by blending a sufficient amount of an aqueous base bituminous emulsion with finely-divided raw lignite containing its inherent moisture to form a moistened green mixture containing at least 3 weight % of the bituminous material, based on the total dry weight of the solids, pelletizing the green mixture into discrete green pellets of a predetermined average diameter and drying the green pellets to a predetermined moisture content, preferrably no less than about 5 weight %. Lignite char and mixture of raw lignite and lignite char can be formed into high strength pellets in the same general manner.

9 Claims, 3 Drawing Figures

PELLETIZING LIGNITE

This is a continuation of application Ser. No. 082,666, filed Oct. 9, 1979 and now abandoned.

BACKGROUND OF THE INVENTION

This invention relates to processing lignite and, more particularly to, a process for forming high strength pellets from lignite having an increased heating value.

Lignite deposits in North Dakota and Montana, totaling more than 200 billion tons, constitute one of the largest energy sources in the United States. Much of this lignite is located close to the earth's surface and can be conveniently and inexpensively mined. However, it has a high moisture content (30–40%) and relatively low calorific or heating value (about 6,500 Btu/lb). Consequently, the market for lignite extends only a few hundred miles from the mining sites because of the transportation cost per delivered Btu exceeds that of higher ranked fuel, such as bituminous coal and higher grades of sub-bituminous coal.

Also, untreated lignite has very poor handling, storage and transportation properties. It tends to break down from the mechanical handling and exposure to air, readily absorbs and releases moisture, is subject to spontaneous combustion during storage because of its high reactivity with oxygen, and breaks down when subjected to freeze and thaw cycles during outdoor storage.

Attempts have been made to agglomerate lignite into briquettes and pellets having sufficient strength for transportation and handling and a moisture content low enough to increase the heating value to a more competitive level, for example, up to 9,500 Btu/lb or more. In one type of agglomeration, lignite briquettes are produced by hot or cold briquetting without binders. In another type of agglomeration technique, inorganic and organic binders, including spent sulfite liquor, derivatives of petroleum and coal distillates, and synthetic resins have been used for agglomerating lignite fines.

While agglomerates having acceptable mechanical strengths and more economical heating values can be produced by some of these techniques, processing costs increases the total cost of the product to a point where it is no longer competitive with other fossil fuels.

Bituminous type binders, particularly asphalt, pitch and tar, can be advantageous because of their low cost and availability, they contain low amounts of objectionable constituents, such as ash, and alkali, they are capable of imparting water-proofing properties, and they add Btu value to the lignite agglomerates. When used as a binder for agglomerating lignite, asphalt usually is sprayed in molten form onto finely-divided particles of lignite. In order to obtain acceptable binding, the normally wet lignite, as received from the mine, must be dried prior to the application of the asphalt. The molten asphalt tends to solidify quite quickly which complicates application and subsequent agglomeration, with a resultant increase in the cost of the final product. Molten asphalt also tends to generate noxious vapors.

SUMMARY OF THE INVENTION

A principal object of the invention is to provide an inexpensive method for processing lignite into a more economical fuel source.

Another principal object of the invention is to provide an inexpensive method for forming lignite, lignite char or mixtures thereof into pellets having heat values higher than raw lignite, high mechanical strengths and resistance to moisture absorption and spontaneous combustion.

A further principal object of the invention is to provide pelletized lignite, lignite char, or mixtures of lignite and lignite char having heating values of at least 9,500 Btu/lb and the other desirable property described in the preceding paragraph.

Other objects and aspects of the invention will become apparent to those skilled in the art upon reviewing the following detailed description, the drawings and the appended claims.

It has been found that lignite, lignite char and mixtures of lignite and lignite char can be formed into high strength pellets having a heating value of 9,500 Btu/lb (ash free basis) or more by using an aqueous base bituminous emulsion as the binder. Such a binder permits raw or run of the mine lignite, after comminution, to be pelletized without substantial prior drying. The bituminous emulsion is uniformly blended with the comminuted lignite in an amount sufficient to form a mixture containing at least about 3 weight %, preferably about 5 to 10 weight % of bituminous material, based on the total dry weight of the solids in the mixture. The resulting mixture is pelletized (adding sufficient moisture to faciliate pelletizing if required) to form discrete green pellets of a predetermined average diameter, and the green pellets are dried to a predetermined moisture content desired for the final product.

Quite surprisingly, it has been found that dried lignite pellets containing some residual moisture exhibit substantially higher strengths than completely dried pellets. Accordingly, the green lignite pellets preferably are dried to a moisture content no less than about 5 weight %, more preferably about 10 to about 30 weight %. This drying can be carried out at a temperature of about 10 to about 350° C.

Lignite char can be formed into pellets having similar strength properties with the same process. The process also can be used to pelletize mixtures of lignite and lignite char.

BRIEF DESCRIPTION OF THE DRAWINGS

FIG. 1 is a simplified flow diagram of illustrating a preferred embodiment of the process.

BRIEF DESCRIPTION OF THE PREFERRED EMBODIMENTS

Figure 2:
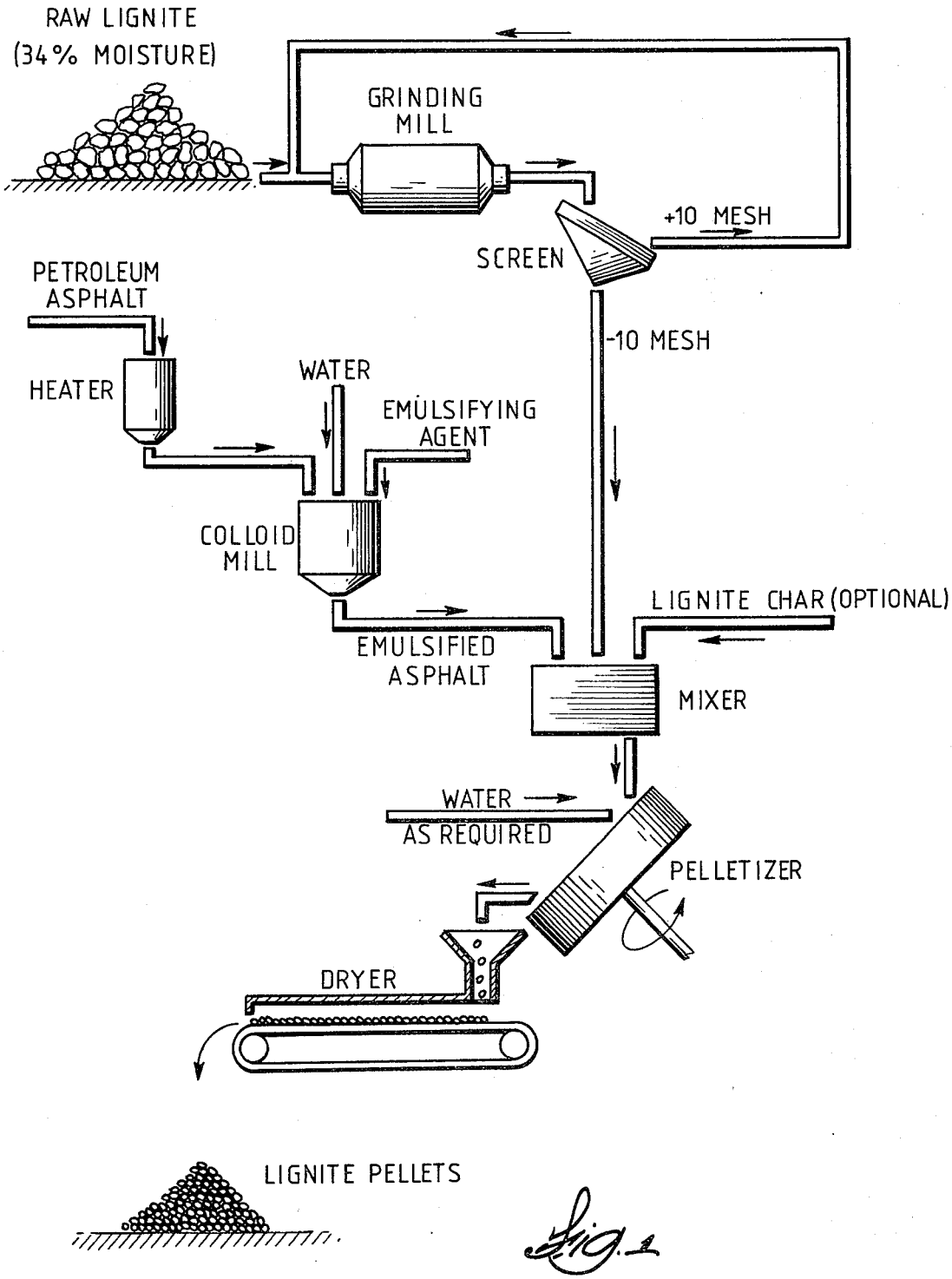
FIG. 2 is a graph illustrating the compressive strength of lignite pellets as a function of moisture content.
Figure 2:
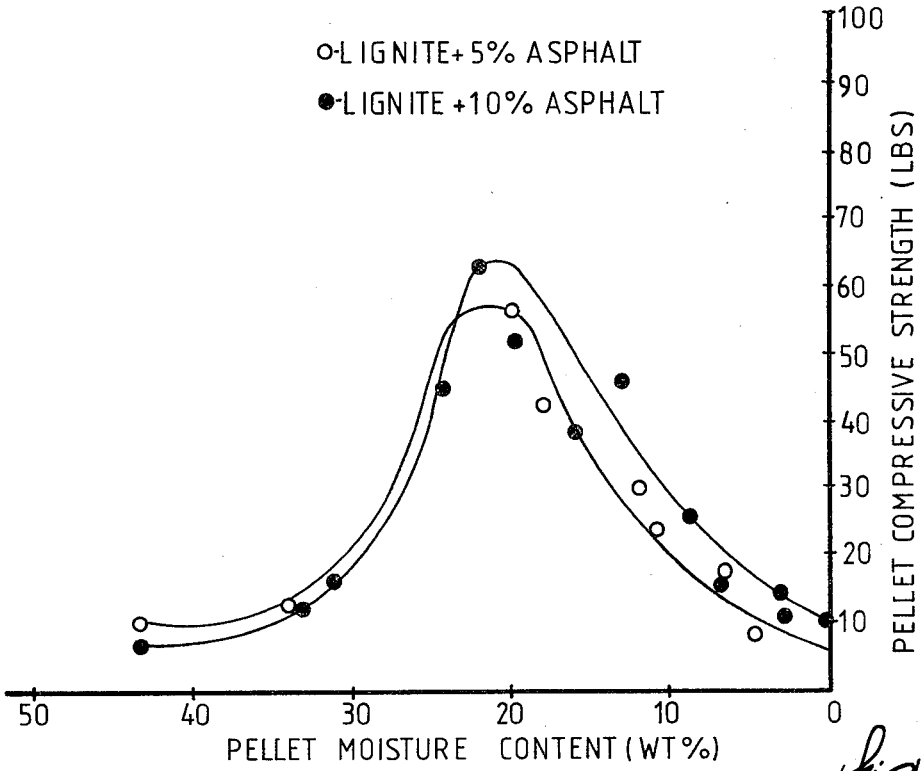

Raw or run of the mine lignite typically contains about 30–40% moisture. As mentioned above, one of the advantages of this invention is that raw lignite, after comminution, can be formed into green pellets without drying, thereby eliminating a costly preliminary drying step typically required by prior art techniques for agglomerating lignite.

FIG. 1 diagrammatically illustrates the equipment and general flow sheet of a preferred embodiment of the process for pelletizing raw lignite. Raw lignite containing about 34 weight % moisture is first ground into a finely-divided form suitable for pelletizing in conventional pelletizing apparatus, such as a balling disc or drum. Although various suitable grinding techniques can be used, rod milling or hammer milling is preferred. Ball milling is somewhat less satisfactory because of a tendency for the moist ground lignite to adhere to the walls of the mill. This can be alleviated by partially drying the lignite prior to grinding; however, the additional drying increases the cost of the final product.

The particle size of the lignite is not particularly critical and depends largely upon the particular pelletizing technique employed. A fine grind, such as −200 mesh required for iron ore, is not required and, in fact, is less desirable because, in addition to the added grinding cost, small particles with larger surface area per unit volume require larger amounts of binder to obtain the same pellet strength. Generally, a particle size ranging from about 10 mesh to less than 325 mesh is acceptable. Lignite fines having a major portion (i.e., at least 50 weight %) between about 10 mesh and 50 mesh and a minor portion finer than 50 mesh, with about 20 weight % −200 mesh, has been found to be particularly satisfactory. In some cases, it may be desirable to remove a minor amount of the moisture, e.g. 1–3%, to facilitate grinding.

After the lignite has been ground and sized with a screen or the like, an aqueous base bituminous emulsion is thoroughly blended therewith. The term "emulsion" as used herein broadly encompasses systems wherein the bituminous material is uniformly dispersed throughout the aqueous phase of an emulsion or a collodial suspension.

The bituminous material used in the emulsion includes those heretofore used in other forms as binders for carbonaceous materials, such as petroleum asphalts, natural asphalts, petroleum bitumen or residium, coal and wood tars, coal-tar pitch, pine-tar pitch, and mixtures thereof. Asphalts derived from petroleum presently are preferred because of their lower costs and generally superior binding properties.

The emulsifying or dispersing agent used to prepare the emulsion can be any conventional type which is capable of forming a stable dispersion of the bituminous material in the aqueous phase and does not include constituents which might be objectionable as part of a fuel. A particularly effective bituminous emulsion contains about 71 weight % water, about 25 weight % petroleum asphalt and about 4 weight % of an emulsifying agent, e.g., corn starch or lesser amounts of a fatty diamine, e.g., Diam 11-C (n-alkyl-1,3-propylenediamine) marketed by General Mills.

In order to produce pellets having acceptable compression and impact strengths, a sufficient amount of the bituminous emulsion is uniformly mixed with the comminuted lignite to provide at least 3 weight % of the bituminous material in the pellets, based on the total dry weight of the solids therein. Pellet strengths can be increased by increasing the amount of the bituminous material incorporated. However, as a practical matter, adding amounts of the bituminous material above about 15 weight % increases the cost of the lignite pellets to a point where they are no longer competitive with other fossil fuels and the added strength is not required for most purposes. The preferred amount of the bituminous emulsion added is that sufficient to provide about 5 to about 10 weight % of the bituminous material in the pellets.

While the ingredients of the bituminous emulsion can be mixed at ambient temperature, the emulsion preferably is prepared by heating the bituminous material to a molten state and mixing it with hot water and the emulsifying agent in a suitable mixer, such as a colloid mill or the like. The bituminous emulsion can be mixed with the comminuted lignite while still hot or at ambient temperatures. The lignite and bituminous emulsion should be very thoroughly mixed in order to insure proper pelletizing.

By adding the bituminous material as part of an aqueous base emulsion instead of in molten form, a homogeneous blend of the bituminous material and the comminuted lignite can be obtained in a conventional mixer without removing any of the inherent moisture from raw lignite or heating the lignite. While not completely understood at this time, it appears that the hydrophobic portion of the emulsion is attracted to organic part of the lignite fines and the water part is attracted to the free moisture in the lignite fines, thereby producing a uniform despersion of the bituminous material throughout the green mixture.

The water content of the green mixture varies depending on the particle size of the lignite fines and the particular pelletizing apparatus used. When a balling disc or a drum is employed with lignite fines less than about 10 mesh, the water content of the green mixture should be about 25 to about 45 weight %, preferably about 28 to 42 weight %. The bulk of this moisture (about 30–35%) can be present from the raw lignite and the balance added during the mixing step and/or to the pelletizer. Of course, some of the additional water required is added along with the bituminous emulsion in either case.

The moistened green mixture is formed into generally spherical pellets having a predetermined average diameter. Generally, the green pellets should have an average diameter of about 10 to about 35 mm, preferably from about 15 to about 25 mm. Green pellets having a diameter much smaller than 10 mm are difficult to handle, whereas pellets having a diameter larger than 35 mm are difficult to dry to the desired final moisture content within practical time periods. Unlike prior processes employing bituminous binders, pelletizing can be carried out with both the green mixture and the pelletizer at ambient temperature.

The green pellets are dried to a predetermined moisture content in a suitable drying apparatus, such as a conveyor belt dryer, a traveling grate, a rotary tray dryer or the like. The pellets can be completely dried (i.e., substantially 0% moisture); however, as mentioned above, dried lignite pellets containing some residual moisture are stronger than those which have been substantially completely dried. In order to obtain pellets having compressive strengths of at least 15–20 lbs. and acceptable impact strengths, the green lignite pellets preferably should be dried to a moisture content of no less than about 5 weight %. For best strengths, the moisture content of the dried pellets more preferably is about 10 to about 30 weight %, most preferably about 20 to 25 weight %.

While the presence of residual moisture in the pellets tends to produce lower heat values, they still have a calorific value of at least 9,500 Btu/lb (ash free basis) in most cases and the significantly lower drying costs required to obtain high strength pellets compensates for the lower heating values. The rate of drying influences pellet strength to some degree, with slower drying generally producing stronger pellets than quick drying. As a guide, suitable drying can be accomplished at a temperature of about 10 to about 350° C. within drying times of about 15 minutes to about 2 hours, with or without air circulation. Air circulation generally should not be used in conjunction with higher temperatures because the resultant high drying rate tends to produce weaker pellets.

The above-described process, with minor modification, can be used to pelletize lignite char (produced by pyrolyzing raw lignite at temperatures of 600°-1000° C. to drive off volatiles) and mixtures of lignite and lignite char. Lignite char pellets usually are somewhat stronger than lignite pellets with the same amount of bituminous material binder and are advantageous for some applications because they do not produce significant amounts of smoke when burned.

The water content of a green mixture of lignite char can be somewhat lower for satisfactory pelletizing, for example, about 26 to about 35 weight %. Since lignite char contains substantially less moisture than raw lignite, larger amounts of water must be added during the mixing step and/or to the pelletizer in order to obtain a green mixture having an appropriate consistency for pelletizing. Otherwise, the same amounts of bituminous emulsion, the same general pelletizing procedure, and the same drying conditions can be used. Lignite char pellets usually exhibit higher compression strengths at lower moisture contents.

Without further elaboration, it is believed that one skilled in the art, using the preceeding description, can utilize the invention to its fullest extent. The following examples are presented to illustrate preferred specific embodiments of the invention and should not be considered as limitations hereto.

EXAMPLE 1

Run of the mine (ROM) lignite obtained from a North Dakota mine and having the chemical analysis set forth in Table 1 was used as a starting material. Samples of this raw lignite (nominally—2 inch as received) was first crushed to—¼ inch in laboratory jaw crusher and then ground without drying to about −10 mesh in a rod mill. The size analysis of the lignite fines are set forth in Table II. A lignite char having the chemical analysis set forth in Table 1 and the size analysis set forth in Table II was produced by heating samples with raw lignite in a externally heated drum under a nitrogen atmosphere and at a temperature of 1,000° F. (538° C.).

Bituminous emulsions were prepared in an electric kitchen blender by adding a 25 g of a melted petroleum asphalt to a hot solution consisting of 4 g corn starch and 71 g water.

2 kg batches of lignite and lignite char were mixed with different amounts of the asphalt emulsion and water for about 2 minutes in a laboratory roller type mixer. The emulsions were freshly prepared and added to a mixture while still hot.

The resulting green mixture was formed into pellets in a 24-inch diameter, 10-inch deep balling disc operated at 40 RPM and ambient temperature. Minor amounts of water were added to the disc for control purposes and spherical green pellets having a nominal diameter of 1 inch (25.4 mm) were formed.

TABLE I

CHEMICAL ANALYSIS OF LIGNITE AND LIGNITE CHAR

| Constituent, Wt. % | Raw Lignite (as received) | Lignite Char |
|---|---|---|
| Moisture | 34. | 2.29 |
| Volatile matter | 49.8 (dry basis) | 13.53 (dry basis) |

TABLE I-continued

CHEMICAL ANALYSIS OF LIGNITE AND LIGNITE CHAR

| Constituent, Wt. % | Raw Lignite (as received) | Lignite Char |
|---|---|---|
| Fixed carbon | 41.61 (dry basis) | 73.87 (dry basis) |
| Ash | 8.59 (dry basis) | 12.6 (dry basis) |
| Sulfur | 0.95 (dry basis) | 0.7 (dry basis) |
| Apparent Density, g/cc | 1.4 | — |
| Porosity, % | 19.4 | — |

TABLE II

SIZE ANALYSIS OF LIGNITE AND LIGNITE CHAR

| TYLER MESH SIZE | WEIGHT % (dry basis) Lignite | Lignite Char |
|---|---|---|
| +10 | 0 | — |
| +14 | 2.19 | 0.20 |
| +20 | 12.11 | — |
| +28 | 15.30 | 5.71 |
| +35 | 13.18 | — |
| +48 | 12.00 | 23.72 |
| +65 | 7.50 | — |
| +100 | 7.03 | 25.45 |
| +150 | 6.06 | — |
| +200 | 5.02 | — |
| +270 | 2.86 | — |
| +325 | 2.20 | 26.46 |
| −325 | 14.55 | 18.46 |
| | 100.00 | 100.00 |

The green pellets were dried to 10 weight % moisture content in a Cenco laboratory oven at 110° C. with no air circulation.

A series of tests were performed on the dry pellets to determine their mechanical strengths. The tests were designed to evaluate the pellets for capability of withstanding compressions to which they are subjected during storage in bins or silos, impacts which occur during loading and transportation, and abrasion during movement in bins or silos.

A manually operated Chatillon testing machine was used to measure the compressive strength of the pellets. The average compressive strengths of 10 or more pellets from each batch are tabulated in Table III.

The ability of pellets to withstand repeated impacts was tested by two different techniques. In one technique, pellets were dropped from a height of 18 inches onto a ½-inch thick steel plate. The average number of drops survived by 10 pellets is tabulated in Table III as the impact number. In another more severe test, the pellets were dropped 8 feet onto a concrete floor. The average number of drops survived by 10 pellets is tabulated in Table III as the drop number.

The tumbling test specified by ASTM-D441-45 (1969) was used to determine the relative friability and dusting properties of the pellets. The optional iron jar containing 500 g pellets was rotated at 50 RPM for approximately 30 minutes. The calculated friability and adjusting index are tabulated in Table III.

TABLE III

PHYSICAL PROPERTIES OF DRIED PELLETS CONTAINING 10% MOISTURE

| PROPERTY | LIGNITE PELLETS Asphalt Conc.(1) 5% wt. % | 10 wt. % | LIGNITE CHAR PELLETS Asphalt Conc.(1) 5 wt. % | 10 wt. % |
|---|---|---|---|---|
| Comp. Strength, lbs. | 28.0 | 40.0 | 14.0 | 39.0 |
| Impact No. | 44.8 | 31.9 | 50+ | 50+ |

TABLE III-continued

PHYSICAL PROPERTIES OF DRIED PELLETS CONTAINING 10% MOISTURE

| PROPERTY | LIGNITE PELLETS Asphalt Conc.(1) 5% wt. % | LIGNITE PELLETS Asphalt Conc.(1) 10 wt. % | LIGNITE CHAR PELLETS Asphalt Conc.(1) 5 wt. % | LIGNITE CHAR PELLETS Asphalt Conc.(1) 10 wt. % |
|---|---|---|---|---|
| Drop No. | 1.2 | 1.9 | 19.5 | 26.3 |
| Tumbling Friability, % | 50 | 18 | 58.9 | 15.4 |
| Dust Index, % | 13 | 4 | 19 | 1 |
| Density, lbs/ft$^3$ | 31.22 | 34.96 | 30.0 | 34.96 |

(1)Weight % of asphalt based on total dry weight of solids in pellets

From these results, it can be seen that pellets having acceptable mechanical strengths can be produced from either raw lignite or lignite char with the process of the invention.

EXAMPLE 2

A series of tests were performed on the lignite and lignite char pellets prepared in Example 1 to determine their resistance to weathering. In a simulated rain test, pellets were sprayed with water for 24 hours. In a water immersion test for simulating possible conditions wherein pellets might stand in water for some period of time during outside storage, pellets were immersed in water for a period of 24 hours. In a test for simulating prolonged storage in desert climates, pellets were placed 6 inches from a 250 watt infrared heat source for 20 cycles of 6 hours each. In a test for simulating repeated freezing and thawing during prolonged storage in cold climates, pellets were frozen in containers (with and without moisture) and thawed for 20 cycles.

The compressive strengths and impact numbers of the pellets were measured on 10 pellets after completion of each test to determine physical degradation. In most of the tests, the lignite pellets containing 10% asphalt had compressive strengths in excess of 15 lbs and an impact number of 15 or more. The lignite pellets containing 5% asphalt had slightly lower compressive strength in most cases. The lignite char pellets containing either 5 or 10% asphalt had compressive strengths in excess of 20 lbs and an impact number of 25 or more in substantially all the tests.

EXAMPLE 3

The compressive strengths and impact numbers of lignite pellets containing different amounts of moisture were measured to determine the effect of residual moisture on the mechanical properties of the pellets. Batches of green lignite pellets prepared in the manner described in Example 1 were divided into lots of 10 pellets. Each lot was weighed and placed separately in a drying oven, operated at 110° C. with no air circulation. At one hour intervals, a lot was removed, cooled to ambient temperature and reweighed to determine the moisture loss for computation of moisture content, and the compressive strengths and impact number was measured as described in Example 1.

Figure 3:
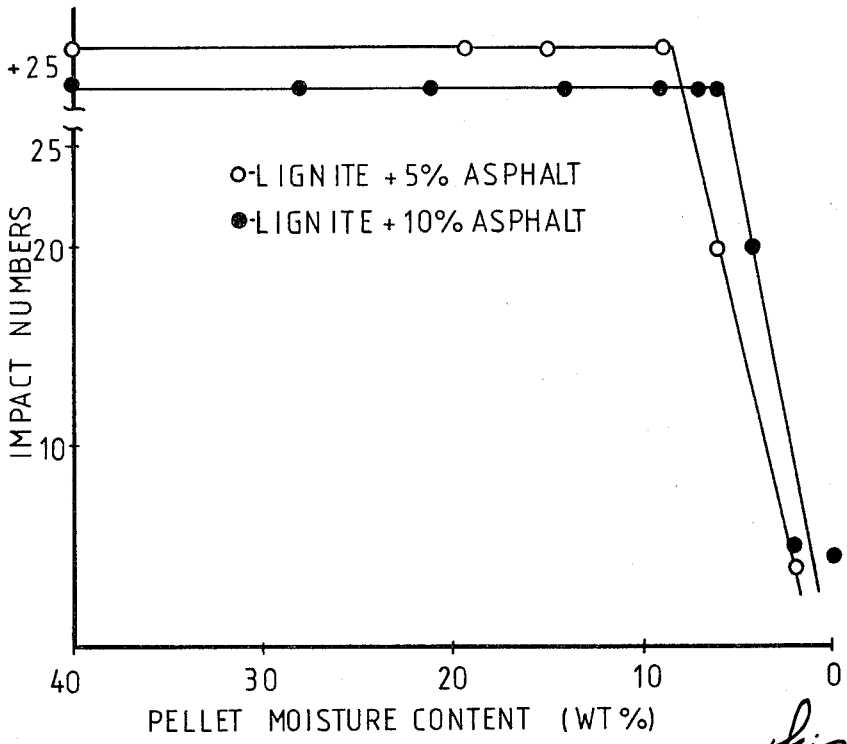
FIG. 3 is a graph illustrating the impact numbers of lignite pellets as a function of moisture content.

FIGS. 2 and 3 graphically illustrate the relationships between the compressive strength and pellet moisture content and impact number and pellet moisture content, respectively. As can be seen in FIG. 2, the compressive strength increases to a maximum when the moisture content is reduced from the 40–45% level for green pellets to about 20–25% and then decreases below about 15 lbs. as the moisture content is reduced to less than about 5 weight %.

As can be seen in FIG. 3, the impact numbers remain substantially constant until the moisture content is reduced below 7–10% and decreases rapidly as the moisture content is reduced further, falling below about 25 at a moisture content of about 5 weight %.

A representative lignite pellet product made with 5% asphalt was found to have the following properties:

| | |
|---|---|
| Moisture, wt % | 7.13 |
| Volatile Matter, wt % (dry basis) | 42.52 |
| Fixed Carbon, wt % (dry basis) | 41.44 |
| Ash, wt % (dry basis) | 8.91 |
| Sulfur, wt % (dry basis) | 1.08 |
| Calorific Value, Btu/lb | 10,004 |
| Compressive Strength, lbs. | 28 |
| Impact No. | 25+ |

EXAMPLE 4

Tests like those described in Example 3 were performed on pellets made from lignite, lignite char and various mixtures of lignite and lignite char. The maximum compressive strengths of green and dried pellets, as well as the compressive strength of dried pellets at 10% and 0% moisture, were determined for each type pellet. The results from these tests tabulated in Table IV.

These results show that, in all cases, the compressive strengths were considerably higher at 10% moisture than at 0% moisture and that the maximums strengths occur at a moisture content within a range of about 20–25%. These results also show that reasonably strong pellets can be produced from mixtures of lignite and lignite char.

From the foregoing description, one skilled in the art can easily ascertain the essential characteristics of the invention and, without departing from the spirit and scope thereof, can make various changes and modifications to adapt the invention to various usages and conditions.

TABLE IV

RELATIONSHIP OF PELLET STRENGTH TO MOISTURE CONTENT

| STARTING MATERIAL | AMOUNT OF BINDER, WT. % | COMPRESSIVE STRENGTH, LBS. Strength at 10% Moisture | Strength at 0% Moisture | Green Pellets(1) | Partially Dried Pellets(1) (Maximum Strength) |
|---|---|---|---|---|---|
| Lignite | 5 | 23 | 6.0 | 10(42) | 56(20) |
| Lignite | 10 | 30 | 10.0 | 7(42) | 65(20) |
| Lignite Char | 5 | 17 | 19.0 | 13(27) | 35(5) |
| Lignite Char | 10 | 52 | 50.0 | 15(25) | 74(5) |
| 90% Lignite/10% Lignite Char | 10 | 30 | 5.0 | 11(41) | 68(20) |
| 80% Lignite/20% | | | | | |

TABLE IV-continued

RELATIONSHIP OF PELLET STRENGTH TO MOISTURE CONTENT

| STARTING MATERIAL | AMOUNT OF BINDER, WT. % | COMPRESSIVE STRENGTH, LBS. Strength at 10% Moisture | Strength at 0% Moisture | Green Pellets[1] | Partially Dried Pellets[1] (Maximum Strength) |
|---|---|---|---|---|---|
| Lignite Char | 10 | 25 | 5.2 | 14(37) | 56(15) |

[1]Moisture Content in parenthesis

I claim:

1. A method for forming high strength pellets from lignite comprising the steps of:

(a) comminuting run of the mine raw lignite into finely divided form without substantial drying;

(b) uniformly blending a sufficient amount of an aqueous base bituminous emulsion with said finely-divided raw lignite to form a moistened mixture containing at least 3 weight % of the bituminous materials, based on the total dry weight of the solids in said mixture;

(c) pelletizing said moistened mixture in a balling means to form discrete, generally spherical, green pellets and having a moisture content of about 25 to about 45 weight %; and (d) drying said green pellets.

2. A method according to claim 1 wherein the amount of said bituminous emulsion added to said mixture is sufficient to incorporate about 5 to about 10 weight % of the bituminous material into said pellets, based on the total dry weight of the solids in said pellets.

3. A method according to claim 1 wherein said green pellets are dried to a moisture content of no less than about 5 weight % during Step (d).

4. A method according to Claim 3 wherein said green pellets are dried to a moisture content of about 10 to about 30 weight % during step (d).

5. A method according to Claim 4 wherein said green pellets are dried to a moisture content of about 20 to about 25 weight % during step (d).

6. A method according to Claim 1 wherein the luminous material is a petroleum asphalt.

7. A method according to claim 1 wherein the particle size of at least a major portion of said lignite is finer than about 10 mesh.

8. A method according to claim 1 wherein step (d) is carried out at a temperature of about 10 to about 350° C.

9. A method according to Claim 7 wherein a major portion of said raw lignite particles in said mixture is between about 10 mesh and 50 mesh and a minor portion is finer than 50 mesh.

* * * * *